US006123005A

United States Patent [19]

Kuchta et al.

[11] Patent Number: 6,123,005

[45] Date of Patent: Sep. 26, 2000

[54] EXTENDED CANISTER FLY-THROUGH COVER

[75] Inventors: Bernard J. Kuchta, San Diego; James L. Gardner, Escondido, both of Calif.

[73] Assignee: The United States of America as represented by the Secretary of the Navy, Washington, D.C.

[21] Appl. No.: 06/649,395

[22] Filed: Sep. 11, 1984

[51] Int. Cl.[7] ..... F41F 3/04

[52] U.S. Cl. ..... 89/1.817; 89/1.816; 89/1.8; 89/8

[58] Field of Search ..... 89/1.817, 1.816, 89/1.8, 8; 220/89 A

[56] References Cited

U.S. PATENT DOCUMENTS

| | | | |
|---|---|---|---|
| 3,140,638 | 7/1964 | De Luca | 89/1.817 |
| 3,499,364 | 3/1970 | D'Ooge | 89/1.817 X |
| 3,851,561 | 12/1974 | Zagala et al. | 89/1.817 X |
| 4,134,328 | 1/1979 | Asp et al. | 89/1.817 |
| 4,373,420 | 2/1983 | Piesik | 89/1.817 X |
| 4,434,905 | 3/1984 | Ou et al. | 220/89 A |
| 4,455,917 | 6/1984 | Shook | 89/1.817 |
| 4,471,684 | 9/1984 | Johnson et al. | 89/1.817 X |
| 4,498,368 | 2/1985 | Doane | 89/1.817 |
| 4,505,180 | 3/1985 | Hinrichs | 89/8 |
| 4,512,491 | 4/1985 | DeGood et al. | 220/89 A |

*Primary Examiner*—Charles T. Jordan
*Assistant Examiner*—M Thomson
*Attorney, Agent, or Firm*—Harvey Fendelman; Michael A. Kagan; Peter A. Lipovsky

[57] ABSTRACT

A cover closes off the open end of a missile launch canister. The cover is designed so as to seal off the interior compartment of the canister to protect the missile or the like contained within it from moisture, contaminants and the conflagration created by nearby fired missiles. The cover is designed to maintain a minimum vapor pressure within the canister for storage purposes and to burst prior to contact by the nose of the missile contained within the canister upon the occurrence of a predetermined accumulation of vapor pressure within the canister after firing of the missile or the like. The cover is formed of a laminate of fiberglass cloths having an electromagnetic interference shield and vapor barrier adhered to the interior surface of the cover. A layer of rubber protects the fiberglass laminate from scratching or puncturing and a polyurethane layer over the rubber layer provides a moisture seal as well as insulation from other contaminants. An aluminum ring is used to secure the cover to the canister.

9 Claims, 3 Drawing Sheets

EXTENDED CANISTER FLY-THROUGH COVER

STATEMENT OF GOVERNMENT INTEREST

An invention described herein may be manufactured and used by or for the Government of the United States of America for governmental purposes without the payment of any royalties thereon or therefor.

BACKGROUND OF THE INVENTION

The present invention relates generally to the field of weapon systems and more specifically to encanistered weapon system covers. Specifically, the present invention relates to the field of covers for canisters utilized as storage and launch tubes for missiles.

Historically, encanistered weapon system covers have been designed to be punctured by the nose of the weapon impacting and pushing through the cover material. Such a system greatly simplifies the cover design for most applications.

FIG. 1 illustrates a prior art canister containing a missile. Specifically, canister 12 contains missile 14 for storage and launch purposes. The canister 12 is closed off at its upper end 16 by canister cover 18. It can be seen in FIG. 1 that the nose 20 of missile 14 actually or nearly comes into contact with the canister cover 18. By so placing the nose 20 of missile 14 in contact with or nearly in contact with the canister cover 18, it can be appreciated that when the missile 14 is fired the nose 20 penetrates the canister cover 18 and it can also be appreciated that any exhaust gases or other gases present in the interior compartment 22 of the canister 12 are vented off prior to the accumulation of any deleterious or dangerous vapor pressures. In order to assist in the breakaway of the canister cover 18, it has been common practice to design the canister cover with pre-formed tear lines such as the tear lines 24 illustrated in dotted lines in FIG. 2 which is a top view of the canister cover 18. It can also be appreciated that when the missile 14 exits from the canister 12 during launch, the pre-formed tear lines 24 on canister cover 18 insure that the segments 26, 28, 30, 32, 34, 36, 38 and 40 petal out from central point 42 as the missile 14 exits from canister 12.

Recent cruise missile designs are stored in and launched from an extended canister. It has been discovered that the missile canister must be made substantially longer than the missile due to the missile launcher configuration (not shown) and for survivability of the missile, the launcher and other missiles stored on the launcher. It has been discovered that the missile canisters must be made substantially longer than the missile to insure that the missile is sufficiently far from the launcher upon exiting from the canister to prevent damage to the launcher and other missiles in the launcher. Such damage occurs due to the conflagration or gas explosion and fire which occurs at the exit end of the canister as the missile exits. The longer missile canister avoids the deleterious effects of these conflagration gases.

FIG. 3 is an illustration of the relative lengths of a cruise missile 44 stored in an extended canister 46. In the Ground Launched Cruise Missile System, the extension area 48 of the canister 46 protects the Transporter Erector Launcher (not shown) internal spaces from heat and blast effects when the missile 44 exits the canister 46. More specifically, the missile 44 is stored in the canister 46 within an inert atmosphere such as dry nitrogen. The inert atmosphere within canister 46 is maintained within the canister 46 at a minimum standby pressure such as, for instance, 3.5 psig.

When the weapon 44 is fired, it accelerates very rapidly and compresses the gas within the canister 46, the missile acting like the piston of an internal combustion engine. A conventional design canister cover 50 would permit this compressed gas to reach far too great a pressure prior to the nose 52 of the weapon 44 punching through the cover 50 in the conventional manner as described above. This pressure build up within canister 46 would tend to cause the cover 50 to bulge out. More importantly, stress analysis has indicated that the pneumatic pressure accumulation within the canister 46, with a rigid cover, would increase to such an extent and exert forces on the sides of the missile 44 to such an extent that the missile tanks or other compartments of the missile 44 would have buckled. In other words, it has been determined that certain thin-walled compartments of the cruise missile 44 could not survive the buckling force created by this rapid increase in pressure occurring at the time of firing of the missile.

SUMMARY OF THE INVENTION

The foregoing problems associated with prior art canister covers are overcome by the canister cover of the present invention in the following ways. The canister cover of the present invention is designed to break or burst before the nose of the missile contained within the canister strikes it in order to vent off dangerous levels of compressed gases. Thus, the canister cover of the present invention breaks pneumatically at a predetermined pressure buildup such as, for instance, 35 psig. Thus, the canister cover of the present invention has a pneumatic burst mode which is reliably predictable and which occurs in less than 35 milliseconds. The canister cover of the present invention further is designed to withstand an environment of a storage pressure such as, for instance, 8 psig for extended periods of time without leaking. Moisture permeability is maintained at an absolute minimum by the design of the canister cover of the present invention. Also, physical protection to the outer surface of the canister cover is provided by the design of the present invention as is electromagnetic radiation screening.

The canister cover of the present invention has the additional advantages that it may be manufactured at relatively low cost. It also has the ability to withstand the operational environment of the Transporter Erector Launcher. Furthermore, the canister cover of the present invention is designed such that no fragments of the cover pose any damage to the missile after launching such as by falling back into the canister due to the fact that the cover of the present invention is designed without the customary pre-formed tear lines as are illustrated in the prior art cover of FIG. 2. The design of the present invention also eliminates the need for any mechanical or explosive cutting device located either on the missile nose or around the canister.

OBJECTS OF THE INVENTION

Accordingly, it is the primary object of the present invention to disclose an improved canister cover used to protect missiles during storage and which avoids the deleterious effects of pressure buildup within the canister following firing of the missile and prior to bursting of the canister cover.

It is a further object of the present invention to disclose a novel canister cover that is designed to maintain a minimum storage pressure and that is designed to burst at a maximum pressure accumulation within the canister.

It is a concommitant object of the present invention to disclose a missile launch canister cover that eliminates the need for any mechanical or explosive cutting device located either on the missile nose or around the canister.

It is a still further object of the present invention to disclose a missile canister cover that can be manufactured at relatively low cost.

It is another object of the present invention to disclose a missile canister cover that is designed to prevent the passage of any electromagnetic energy and withstand the operational environment of the Transporter Erector Launcher.

It is a further object of the present invention to disclose a canister cover that has improved moisture permeability protection and that minimizes moisture permeability into the interior compartment of the weapons canister.

These and other objects of the invention will become more readily apparent from the ensuing specification when taken together with the accompanying drawings.

DESCRIPTION OF THE PREFERRED EMBODIMENT

Figure 1:
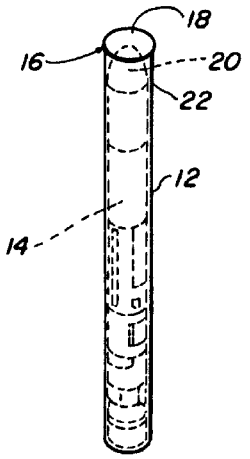
FIG. 1 PRIOR ART
FIG. 1 is an isometric view of a prior art weapon such as a missile incorporated within a storage-launch canister, illustrating the approximate equal lengths of the missile and canister.
Figure 2:
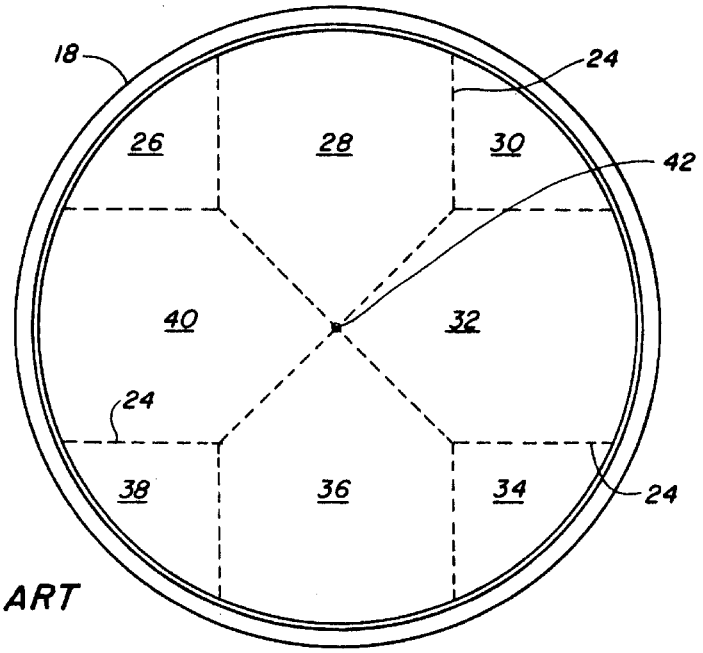
FIG. 2 PRIOR ART
FIG. 2 is a top view, schematic illustration of a prior art missile canister cover illustrating the pre-formed tear lines customarily used on such canister covers.
Figure 3:
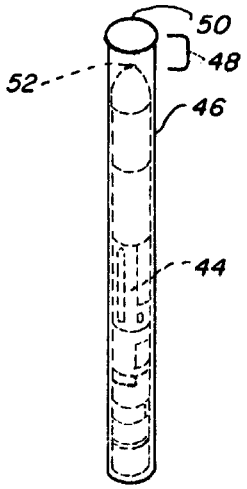
FIG. 3 is an isometric illustration of a missile stored within an extended length canister illustrating the relative lengths of the missile and the extended length canister and illustrating the ullage area between the nose of the missile and the extended length canister cover.
Figure 4:
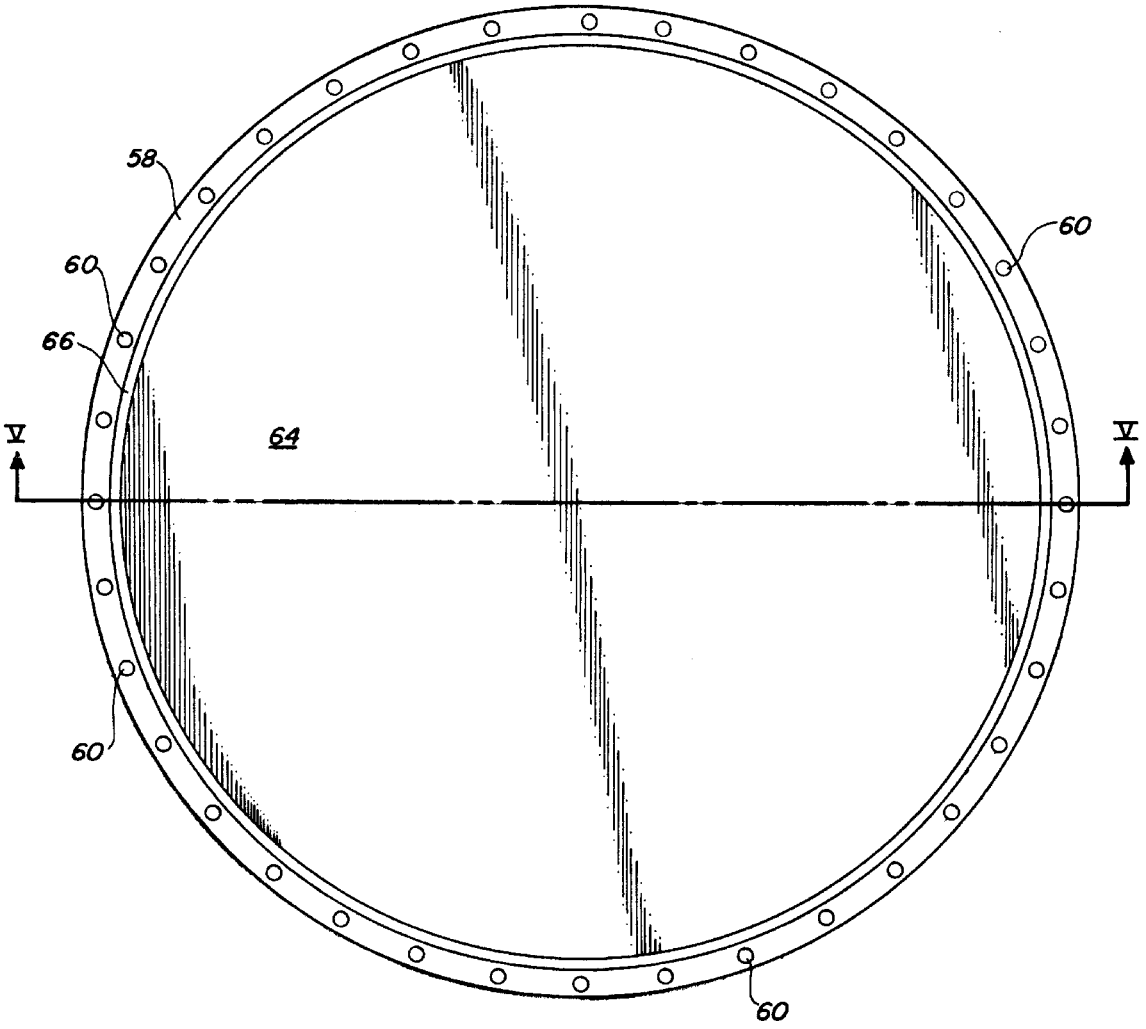
FIG. 4 is a top view of the canister cover of the present invention.
Figure 5:
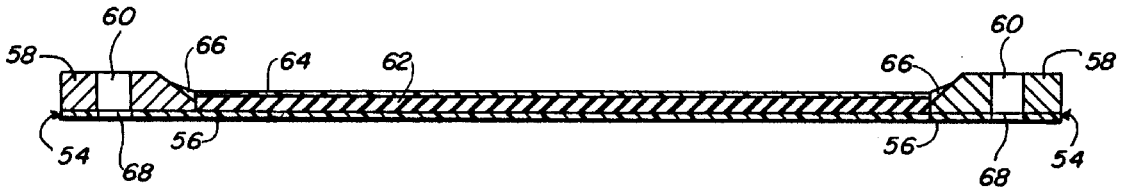
FIG. 5 is a cross-sectional side view of the canister cover of the present invention taken along lines V—V in FIG. 4.

Referring now to FIGS. 4 and 5, the assembly of the canister cover of the present invention will be described. The canister cover is comprised of a laminate disc assembly 54. On the interior surface, i.e. the surface of the disc assembly that faces the interior compartment of the canister, a layer of aluminum foil 56 is bonded to the laminate disc assembly 54. Construction of the laminate disc assembly 54 will be described in greater detail below. An aluminum mounting ring 58 is bonded to the outer periphery of the laminate disc assembly 54. The aluminum mounting ring 58 has a series of holes 60 drilled into it for securing the cover to the canister (not shown). Next, a protective cover 62 preferably made of neoprene rubber is bonded to the exterior surface of the laminate disc assembly 54 and to the mounting ring 58. A polyurethane protective coating 64 is sprayed onto the exterior surface of the protective rubber cover in the following manner, set forth by way of example. First, protective rubber cover 62 is made from a sheet of neoprene foam rubber such as MIL-R-6130, Type II, Grade A and 0.125" thick. The sheet of neoprene is cut approximately ¼" larger than the inner diameter of aluminum mounting ring 58 to allow for shrinkage of the rubber. Next, a polyurethane elastomer is thoroughly mixed and permitted to age to achieve the desired application characteristics for a spray application. The aging temperature should be between 60° F. and 100° F. Thinning of the aged elastomer should be done only with addition of freshly mixed elastomer. The polyurethane is sprayed onto the surface of the protective cover 62 and is worked in to the pores of the foam rubber by using a squeegee or preferably a brush. The polyurethane is permitted to stand at least five minutes before further applications but not more than ten minutes. Another quantity of polyurethane is sprayed onto the surface of the previously applied layer and a visual inspection for pores is made. Again, the polyurethane layer that has been sprayed on is permitted to stand for five or ten minutes. Successive layers of polyurethane are sprayed onto the surface of the previously applied layers as many times as necessary to give a continuous elastomer surface. The sprayed on polyurethane layers are then permitted to stand overnight or may be heated for two hours at a temperature of 120° F.±10° for curing.

Finally, a bead of suitable caulking type material 66 is set in the joint between the aluminum mounting ring 58 and the protective rubber cover 62 with its overlying polyurethane coating 64.

Figure 6:
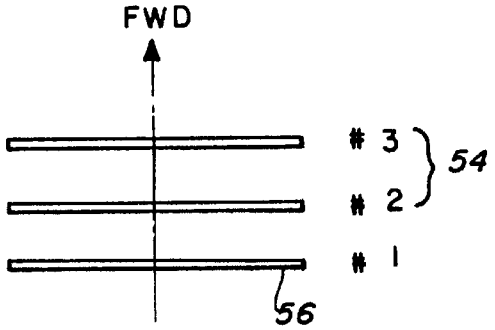
FIG. 6 is an exploded side view of the laminated disc assembly of the canister cover of the present invention.
Figure 7:
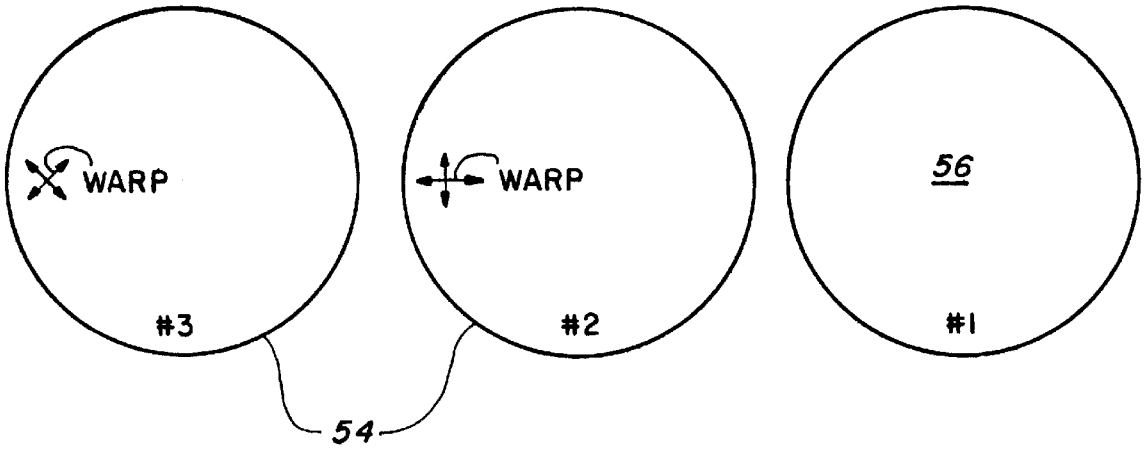
FIG. 7 is a schematic illustration of the relative positioning of the warp fibers of the fiberglass cloth used to make the laminate disc portion of the present invention.

The fiberglass laminated disc 54 is preferably formed from two separate layers of fiberglass cloth. For instance, a layer of 120 series pre-impregnated fiberglass cloth may be utilized for the layer denoted as layer No. 2 illustrated in FIG. 6, layer No. 2 being the layer that is adjacent the foil layer 56 denoted as layer No. 1 in FIG. 6. Further, a layer of 180 series pre-impregnated fiberglass cloth may be utilized for the layer denoted as layer No. 3 in FIG. 6. The foil layer 56 denoted as layer No. 1 in FIG. 6 may comprise, for instance, two mil thick aluminum sheeting. The layer 56 serves as an electromagnetic interference shield and also serves to keep moisture from entering the interior of the canister that is sealed by the cover of the present invention. The aluminum foil 56 may, for instance, be comprised of the foil layer of Cycom AEL-100/1100, which is a laminate of 120 fiberglass and aluminum foil, having adhesive backed aluminum foil adhered to the 120 fiberglass and which is manufactured by American Cyanamid Co. of Havre de Grace, Md. In order to achieve the necessary strength levels of the laminated disc assembly 54 the two layers, layers No. 2 and No. 3 that constitute the laminated disc assembly 54 are preferably formed by orienting the warp fibers of the two layers of fiberglass cloth in the manner depicted in FIG. 7. Specifically, FIG. 7 illustrates an orientation of 45° of the warp fibers of the two respective layers of fiberglass cloth.

The procedure for bonding the two layers, layer No. 2 and layer No. 3 of the laminated disc assembly 54 to each other is as follows. A lay-up table such as a metal covered, level table is first prepared by covering the metal surface of it with a mold release agent for epoxies such as a spray-on Teflon agent. The sprayed table top is then covered with a non-perforated Teflon sheet or silicone rubber mat. Next, a length of, for example, Cycom AEL 100/1100 fiberglass/foil laminate is cut to a suitable size. For instance, the length of Cycom AEL 100/1100 may be cut into 26"×26" squares or it may be placed in one large sheet, with the aluminum side down, onto the lay-up table. The direction of warp of the warp fibers of the fiberglass layer of the Cycom AEL 100/1100 will be considered 0° warp. If a continuous sheet of Cycom AEL 100/1100 is used 26"×26" squares are marked off. Whether using a continuous sheet of Cycom AEL 100/1100 or precut 26"×26" squares of same, 24"×24" squares are then marked off and centered within the 26"×26" squares leaving 1" borders. Next, 180 series fiberglass epoxy is cut into 24"×24" squares at an angle of 45° with respect to the warp fibers and the squares are placed into the marked 24"×24" squares on the Cycom AEL 100/1100. A layer of Teflon sheet or a silicone rubber mat is then put in place to cover the lay-up previously described. Next, over each lay-up area a 24"×24" aluminum caul plate having a thickness between 1/32 and 1/16" is put in place. Each caul plate is then surrounded with a strip of permeable cloth such as "Armalon", which is a Teflon covered fiberglass material. The permeable cloth is overlapped over the caul plates to insure vacuum integrity. Alternatively, one caul plate can be used to cover all of the lay-up areas. In this case, the aluminum caul plate should extend to cover all of the 24"×24" 180 fiberglass lay-up areas plus at least ½" or more. Again, the permeable cloth strips should be folded up and over the caul plate and overlap on top of the caul plate. A bag comprised of any suitable bagging material such as vinyl or Teflon is then used to cover all of the lay-up areas and the edges of the bag are sealed to the table top by suitable means such as tape. The bag is equipped with an inlet tube such that the atmosphere within it may be withdrawn by connecting the inlet tube to a vacuum pump. When vacuum pressure is applied to the inlet tube of the bag, the bag collapses and exerts vacuum pressure against the lay-up areas. At least 22" of mercury vacuum should be maintained. Next, the lay-up table including all of the lay-up areas and the vacuum bag are placed in an oven and cured at 350° F.±10° F. for 120±10 minutes. Mercury vacuum should be maintained between 22" and 28" during this procedure. Finally, the table, vacuum bag, and lay-up areas are removed from the oven. Alternatively, the lay-up table and vacuum bag and lay-up areas may be placed in an autoclave at room temperature while maintaining a vacuum pressure within the vaccum bag between 22 and 28" of mercury. The pressure in the autoclave may be then raised to 45 psi±5 psi and the temperature increased to 350° F.±10° F. or 120 minutes. Once the autoclave pressure is up to 45 psi±5 psi, the vacuum is not essential but may be maintained. Following this procedure, the workpieces are cooled within the autoclave to a temperature below 140° F. and removed from the autoclave.

The laminated squares of layers No. 2 and 3 of the laminated disc assembly 54 may then be cut into the proper disc shape and size. Following this shaping operation, holes 68 are made in the laminated disc assembly 54 to align with the holes 60 in the aluminum mounting ring 58. The aluminum mounting ring 58 is then bonded to the outer periphery on the exterior surface of the laminated disc assembly 54. Following this operation, an adhesive is utilized to bond the protective rubber layer 62 to the exterior surface of the laminated disc assembly 54 within the interior of aluminum mounting ring 58. Well known adhesive epoxy bonding techniques may be utilized to so bond the rubber protective layer 62. For example, to bond layer 62 to laminate assembly 54, the process steps involve solvent cleaning the surface of the laminate disc assembly 54, abrading the surface with abrasive paper to produce a lusterless surface appearance without damaging the fiber reinforcement, and removing loose particles by wiping the abraded surface with non-lint producing cloth dampened with 1,1,1 trichloroethane or aliphatic naphtha. Following the wiping step the cleaned surfaces are permitted to dry and a low viscosity adhesive epoxy is spread on each mating surface and the adherents are then joined and placed under pressure that is evenly distributed throughout the bond area. The adhesive is then allowed to cure for a suitable curing time such as five days at ambient temperature or may be cured more rapidly for two hours at increased temperatures such as 145° F. It is noted that the protective rubber cover 62 protects the laminated disc assembly 54 from puncturing or scratching during handling of the item.

The next step in the manufacture of the cover of the present invention is the spraying on of a resinous polyurethane protective coating 64 over the exterior surface of the protective rubber cover 62. This polyurethane coating 64 serves to keep moisture and other contaminants from entering the protective rubber layer 62. Layer 62 also insulates against heat and blast effects from launches from adjacent canisters.

Finally, the layer of caulk material 66 is applied by known techniques to the joint between the aluminum mounting ring 58 and the two layers constituting the rubber protective cover 62 and the polyurethane protective coating 64.

Obviously many modifications and variations of the present invention are possible in the light of the above teachings. It is therefore to be understood that within the scope of the appended claims the invention may be practiced otherwise than as specifically described.

What is claimed is:

1. In the combination of a canister for containing a missile or the like wherein the canister includes a closed end and an open end through which the missile or the like exits, and a cover for said open end for closing off said open end to protect the missile or the like from corrosion due to moisture and from other deleterious effects, and improved cover comprising:

means comprising a disc of burstable material having no pre-formed tear lines for sealing said open end of said canister so as to maintain a predetermined inert vapor within said canister during storage of said missile and for bursting when said missile or the like is fired upon the accumulation of a precise predetermined maximum vapor pressure within said canister so as to vent off said vapor prior to the occurrence of pneumatically caused damage to said missile or the like.

2. The improved cover of claim 1 wherein said sealing means comprises:

a laminated disc having an exterior side and an interior side;

a protective cover having an interior side disposed on said exterior side of said laminated disc for protecting said laminated disc from punctures, scratches and the like; said protective cover having an exterior side; and a layer of sealant disposed on said protective cover exterior side for preventing moisture and other contaminants from entering said protective cover material.

3. The improved cover of claim 2 wherein said protective cover comprises rubber.

4. The protective cover of claim 2 wherein said laminated disc comprises:

first and second laminated layers of fiberglass.

5. The protective cover of claim 4 wherein:

the warp fibers of said first layer of fiberglass are oriented at an angle of 45°±3° with respect to the warp fibers of said second layer of fiberglass.

6. The improved cover of claim 2 wherein said sealing means further comprises:

an electromagnetic interference shield disposed on said interior side of said laminated disc.

7. The improved cover of claim 6 wherein said electromagnetic interference shield comprises a layer of aluminum.

8. The protective cover of claim 7 wherein said layer of sealant comprises polyurethane.

9. A cover for a missile launch canister comprising:

a disc of burstable material having no pre-formed tear lines said disc comprising:

a laminated assembly of fiberglass having exterior and interior surfaces;

a layer of aluminum disposed on said laminated assembly interior surface;

a layer of rubber having exterior and interior surfaces, said interior surface of said layer of rubber being disposed on said exterior surface of said laminated assembly of fiberglass;

a protective coating of polyurethane disposed over said exterior surface of said layer of rubber; and a retaining ring disposed over the periphery of said exterior surface of said laminated assembly of fiberglass.

* * * * *